US011286937B2

(12) United States Patent
Lathouwers et al.

(10) Patent No.: US 11,286,937 B2
(45) Date of Patent: Mar. 29, 2022

(54) ELECTRICALLY DRIVEN MOBILE COMPRESSOR OR PUMP AND METHOD FOR CONTROLLING THE MAXIMUM CURRENT THAT IS TAKEN FROM A POWER SUPPLY

(71) Applicant: ATLAS COPCO AIRPOWER, NAAMLOZE VENNOOTSCHAP, Wilrijk (BE)

(72) Inventors: Bert Jozef I. Lathouwers, Wilrijk (BE); Antoon Stuer, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 225 days.

(21) Appl. No.: 16/089,470

(22) PCT Filed: Apr. 7, 2017

(86) PCT No.: PCT/BE2017/000024

§ 371 (c)(1),
(2) Date: Sep. 28, 2018

(87) PCT Pub. No.: WO2017/173507

PCT Pub. Date: Oct. 12, 2017

(65) Prior Publication Data

US 2019/0128262 A1 May 2, 2019

(30) Foreign Application Priority Data

| | | |
|---|---|---|
| Apr. 8, 2016 | (BE) | 2016/5245 |
| Oct. 10, 2016 | (BE) | 2016/5759 |
| Apr. 5, 2017 | (BE) | 2017/5241 |

(51) Int. Cl.
*F04C 28/28* (2006.01)
*F04B 49/06* (2006.01)
(Continued)

(52) U.S. Cl.
CPC ..... *F04C 28/28* (2013.01); *F04B 35/04* (2013.01); *F04B 49/06* (2013.01); *F04B 49/065* (2013.01);
(Continued)

(58) Field of Classification Search
CPC ..... F04B 49/065; F04B 49/06; F04B 2203/0201; F04B 35/04; F04B 2203/0208; F04B 49/20; F04B 51/00
See application file for complete search history.

(56) References Cited

U.S. PATENT DOCUMENTS

| | | | | |
|---|---|---|---|---|
| 5,715,797 | A | 2/1998 | Minagawa et al. | |
| 8,228,648 | B2 * | 7/2012 | Jayanth | H02H 7/09 361/30 |

(Continued)

FOREIGN PATENT DOCUMENTS

| | | | |
|---|---|---|---|
| DE | 19625902 | A1 | 3/1997 |
| DE | 102012024400 | A1 | 6/2014 |

(Continued)

OTHER PUBLICATIONS

International Search Report in related PCT Application No. PCT/BE2017/000024, dated Sep. 6, 2017.

(Continued)

*Primary Examiner* — Dominick L Plakkoottam
(74) *Attorney, Agent, or Firm* — Bacon & Thomas, PLLC

(57) ABSTRACT

Electrically driven mobile compressor or pump, comprising at least one compressor element or pump element for supplying a pressurised fluid to a network of consumers of such pressurised fluid; an electric drive motor with a variable speed control coupled to the compressor element or pump element and a controller for the variable speed control of the electric drive motor as a function of the flow rate of compressed gas and/or pressure demanded by the network,
(Continued)

and a connection for connection of the compressor or pump to an electricity supply source, and the controller is provided with an algorithm with which the electric current drawn from the supply source can be limited to a set or adjustable maximum value by controlling the speed.

27 Claims, 2 Drawing Sheets

(51) Int. Cl.
*F04C 28/08* (2006.01)
*F04C 28/24* (2006.01)
*F04B 35/04* (2006.01)

(52) U.S. Cl.
CPC ..... *F04C 28/08* (2013.01); *F04C 28/24* (2013.01); *F04B 2203/0201* (2013.01)

(56) References Cited

U.S. PATENT DOCUMENTS

2003/0106582 A1* 6/2003 Jeong ..... G05D 9/12 137/2
2006/0204372 A1 9/2006 Scampoli
2008/0069708 A1* 3/2008 Beckman ..... F04B 49/20 417/410.1
2013/0156607 A1* 6/2013 Jayanth ..... H02H 3/006 417/44.11
2014/0271232 A1* 9/2014 Kopko ..... F25B 49/025 417/44.1
2015/0285264 A1* 10/2015 Kennedy ..... F04B 39/06 417/53
2015/0345490 A1* 12/2015 Bremeier ..... H02P 1/24 417/22
2016/0012723 A1* 1/2016 Biderman ..... B60R 16/02 340/990
2016/0076536 A1* 3/2016 Jayanth ..... F04D 27/00 702/60

FOREIGN PATENT DOCUMENTS

DE 102014217185 A1 3/2016
EP 2028759 A2 2/2009
EP 2995816 A1 3/2016
WO 2006082366 A1 8/2006
WO 2011083167 A1 7/2011

OTHER PUBLICATIONS

Written Opinion in related PCT Application No. PCT/BE2017/000024, dated Sep. 6, 2017.

* cited by examiner

ELECTRICALLY DRIVEN MOBILE COMPRESSOR OR PUMP AND METHOD FOR CONTROLLING THE MAXIMUM CURRENT THAT IS TAKEN FROM A POWER SUPPLY

The present invention relates to an electrically driven mobile compressor or pump.

BACKGROUND OF THE INVENTION

In the following the invention is described for compressors, but entirely analogously the invention also relates to pumps, whereby a pump serves to pressurise a liquid or liquid mixture just as a compressor serves to compress a gas or gas mixture.

If no (fixed) compressed air network is available and compressed air is needed then typically a mobile compressor is used.

Mobile here means a compressor that is intended to be movable, for example from one site to another, even if means of transport or tackle are needed for this. In brief, a compressor that is not intended to be used immovably at a fixed place.

Mobile compressors are often driven by a combustion engine, so that it can operate independently.

However, such mobile compressors have various disadvantages.

Not only do they emit combustion gases and soot and are noisy, the fuel tank also has to be regularly filled up, which not only means extra work but also brings about the risk of spillage and thus soil pollution.

These disadvantages can be met by deploying a mobile electrically driven compressor. This mobile electrically driven compressor is connected to an electricity supply source such as an electrical grid or an electric generator.

Typically such an electricity supply source is only suitable up to a maximum permissible electric current, and at a higher consumed electric current the safe operation of some components of the electricity supply source or the connection thereto is possibly no longer guaranteed. In this way, at higher currents for example certain current carrying conductors can overheat and cause fire or fire damage.

Generally protective devices are built into the supply source, which disconnect the compressor from the supply source, the electrical grid and/or the electric generator when a certain set electric current is reached for example, for example by means of a fuse that cuts out as soon as the current passing through it is greater than the set amperage for which the fuse is intended.

A problem that can arise is that when an electrically driven compressor is connected that can draw a higher current than the maximum electric current for which the electrical grid and/or electric generator is suitable, it can suddenly exceed the maximum electric current during the use of the electrically driven compressor with an increasing load, which with a correctly operating protected connection leads to the cut out of the aforementioned fuse.

However, when the fuse cuts out, other applications can also be taken out of service, for example lighting that goes off, which can lead to an unsafe situation. Moreover this can be coupled with a significant time loss, because the fuse must be reactivated, which often can/may only be done by a technician with the right technical qualifications, and for which a torch or similar is needed that is often not immediately available, which can again lead to accidents.

A solution to this problem is described in Ser. No. 04/065,793 for an electrically driven mobile compressor, whereby the power of the compressor is limited by means of a controllable mechanical inlet valve, such that the maximum electric current drawn is limited according to the available electrical connection or fuse.

However, this solution of WO 2004/065,793 has various disadvantages, i.e. that such mechanical control must be accurately set and after the passage of time it can easily drift, for example due to fouling of the filters or wear and tear due to vibrations on the valve mechanism, so that there is still a risk of the maximum electric current of the fuse or similar being exceeded.

The partial closure of the inlet valve not only leads to a lower power, but also to a greater flow resistance of the gas to be compressed that is drawn in, which greatly reduces the efficiency of the compressor.

Another disadvantage of the solution described in WO 2004/065,793 is that, if in addition to the mobile compressor other electrical equipment or consumers are connected to the same electricity supply source, the compressor must be limited to a maximum current that is equal to the maximum available current of the supply source minus the combined maximum current that can be drawn by the other connected electrical consumers at the same time.

When in this case the simultaneously connected electrical consumers do not utilise their maximum current, then the available current and thus the power of the compressor is needlessly limited and a significantly reduced capacity of the supplied compressed gas is thus available.

Another disadvantage of the solution described in WO 2004265793 is that during the use of the compressor with a setting of the maximum current, it is not clear for the user whether the maximum current has been reached, or in a broader sense how much of the corresponding available power he is using.

An additional problem of the compressor described in WO 2004/065,793 is that the compressor cannot supply greater power to the consumers of compressed gas than the corresponding maximum electric current that is available from the electricity supply source.

SUMMARY OF THE INVENTION

The purpose of the present invention is to provide a solution to one or more of the aforementioned and other disadvantages.

To this end the invention concerns an electrically driven mobile compressor or pump comprising at least one compressor element or pump element for supplying a pressurised fluid to a network of consumers of such pressurised fluid, an electric drive motor with a variable speed control coupled to the compressor element or pump element, and an electric or electronic controller comprising a first controller configured to control the speed n or the pressure p of the compressor or pump, respectively as a function of a set desired pressure or set desired flow rate, or a speed corresponding thereto, of the pressurised fluid demanded by the network and a second controller configured for the variable speed control of the electric drive motor as a function of a desired speed that is determined by the first controller, and a connection for connecting the compressor or pump to an electricity supply source, whereby the controller is provided with an algorithm with which the electric current drawn from the supply source can be limited to a set maximum current by limiting the desired speed, or the desired pressure, to a maximum value and whereby the electric or electronic control that limits the speed or the pressure in order not to exceed a maximum drawn current, is a control with a fixed set value of the maximum speed or of the maximum pressure, whereby this value is calculated or determined as a function of the characteristics of the machine and based on the set maximum current to be drawn together with the set desired pressure, or based on the set maximum current to be drawn together with the set desired flow rate respectively.

In summary this means that:

when a desired pressure has been set, the pressure is maintained and the speed is controlled to maintain the pressure for as long as the current drawn is below the set maximum current, and that, as soon as the drawn current reaches the set maximum current, the maximum speed is limited;

when a desired flow rate has been set, the speed corresponding to the set flow rate is maintained and the pressure is adjusted to maintain the flow rate or speed for as long as the current drawn is below the set maximum current, and that, as soon as the drawn current reaches the set maximum current, the maximum pressure is limited.

An advantage is that such an electric or electronic control by limiting the maximum speed or maximum pressure is not coupled with flow losses and the efficiency losses arising from this such as with the known mechanical controls.

Another advantage is that such a control is easy to realise.

Alternatively the electric or electronic control can also make use of a closed-circuit control whereby the drawn current is measured or determined and limited as a function of the set maximum current.

Preferably the mobile compressor is equipped to this end with means to be able to measure or determine the drawn current continuously or at intervals, and the algorithm in the controller is such that when the measured drawn current is below the set maximum current, the control of the speed by the aforementioned second controller, respectively the control of the pressure by the aforementioned first controller, is left undisturbed and that when the measured drawn current is equal to or greater than the set maximum current, the controller will keep the maximum speed, or the maximum pressure, constant or decrease it until the measured drawn current is again below the set maximum current.

The drawn current can be measured for example by the second controller of the variable speed control or by a separate ammeter in the connection to the supply source. The measured drawn current is then compared by the controller to the set maximum current, and then the desired maximum speed of the electric drive motor, or the maximum pressure of the compressor element, is adjusted in order not to exceed the maximum current.

It is also possible to set a safety margin for the maximum current so that the control already intervenes when the drawn current is equal to or just greater than the maximum current minus the safety margin.

Because in the last case the control measures and controls the drawn current, a control according to the invention is independent of influences that make the drawn current increase such as in the event of wear and tear, fouling of filters, or similar, such that in the case of the invention there is no risk that the maximum permissible current is undesirably exceeded due to these influences.

The maximum current for the electric control system can be set in different ways.

In the simplest embodiment the mobile electrically driven compressor is provided with a multiposition switch with at least two positions, with each position corresponding to a maximum electric current. Such a multiposition switch can be realised in the form of a rotary knob with a selection scale, pushbuttons or other.

It is also possible that the maximum current can be set analogously, for example with a rotary knob provided with a graduation.

Typically the maximum current values for power points are standardised in a certain country, and after selecting the corresponding maximum current value on the electrically driven compressor, it can simply be connected to the power point and used directly. In this way the same mobile electrically driven compressor can easily be used in different countries and with a connection to different power points.

For a three phase connection 16, 32, 63 and 125 amperes are usual maximum current values in Europe for example, and in the United States 20, 30 and 50 amperes.

For single phase connections 16 amperes in Europe for example, in the United Kingdom 13 amperes, and in the United States 15, 20, 30 and 50 amperes are usual maximum current values.

Typically a certain voltage and frequency are also used in a certain country or region.

For a three phase connection 400 volts and 50 Hz are usual in Europe, 480 volts and 60 Hz in the United States, 380 volts and 60 Hz in Brazil, 575 volts and 60 Hz in Canada, and both 200 volts and 50 Hz and 200 volts and 60 Hz in Japan.

For a single phase connection 230 volts and 50 Hz are usual in Europe and the United Kingdom, 120 volts and 60 Hz in the United States.

In order to simplify the setting of the maximum current value for the user, it is also possible to provide two controls, for example two multiposition switches, whereby with one multiposition switch the country, region, voltage and/or frequency can be selected, and whereby, as a function of the chosen position, the selection scale of the other multiposition switch is adjusted so that this last multiposition switch can be set to a maximum current value that is common in the country or region concerned.

It is also possible that the maximum current is set via a selection option in the general operating controller of the compressor. Or a choice can be made via the selection option between two or more maximum current values and if applicable the possibility of a freely chosen maximum current value, or a maximum current value can be entered directly. If applicable, prior to setting the maximum current the country, region, voltage and/or frequency can first be set with a selection option, so that the selection is simple and limited.

It is also possible that the maximum current values are set automatically. For example, the mobile compressor can be provided with means to measure the voltage and/or frequency of the electrical grid to which the mobile compressor is connected, and on the basis of this the selection scale is adapted to the maximum current values. It is also possible that the selection scale is adapted to the maximum current values on the basis of GPS coordinates. The GPS coordinates can be obtained from a GPS chip in the mobile compressor itself or by communication with another device with a GPS chip, such as a smartphone for example.

It is possible that the end user himself can set this selection option(s), or that it is protected in one or another way, for example with a password, hardware key or similar.

Thus for example a lessor of such compressors who has the password and/or hardware key can set the maximum current on the mobile electrically driven compressor for the end user to whom he rents the mobile electrically driven compressor, and this end user cannot exceed the maximum current set by the lessor.

For example the lessor can set the mobile electrically driven compressor for a certain usage, for example a certain capacity for driving a certain number of pneumatic tools, for example two pneumatic drills.

This provides the advantage that the lessee of the compressor does not have to pay too much for too heavy a compressor when the lessor cannot offer him a lighter compressor with a lower power for which the lessee needs the compressor.

For example, with a different password and/or hardware key the compressor can be adjusted by the manufacturer and/or lessor for a certain country/region by setting the standard maximum current values applicable in that country/region as a selection option.

Optionally the electrically driven mobile compressor according to the invention can be provided with one or more electrical connections that are intended for any electricity supply for external electrical consumers, whereby the current for one or more connections is tapped off at a place downstream from the means for determining or measuring the drawn current, so that the current that is measured with the aforementioned means is the current that is jointly drawn from the supply source by the compressor and by the electrical consumers connected to the electrical connections concerned.

This provides the advantage that, in contrast to situations with known mobile compressors, the electric control system of the compressor ensures that the total maximum current remains limited, thus the sum of the electric currents for the electric mobile compressor and the other electrical equipment connected to one or more connections to the mobile electrically driven compressor. In this way the mobile electrically driven compressor can always fully utilise the available electric current, thus the electric power.

Another possible useful option can consist of equipping the compressor with a signal or indication that indicates when the maximum current is reached or is almost reached, or which indicates how much of the available current or power is consumed or is still available. This can be done for example by means of a tone being issued, a light coming on and/or one or another presentation on a display or dial.

According to a particular aspect of the invention, the electrically driven mobile compressor can be provided with two or more connections for connection to two or more different electricity supply sources that can provide the compressor with current in parallel simultaneously, so that the available electric power of one supply source can be supplemented by the available power of one or more other supply sources if the available power of the first supply source turns out to be insufficient for the intended application.

In this way, for example, the available power from the electrical grid can be supplemented with power originating from a battery pack with one or more batteries.

When additionally the mobile electrically driven compressor is not used and is connected, then the batteries can be charged with an electric current that is less than the maximum current of the connection. When the mobile electrically driven compressor is used, then the electric mobile compressor can utilise a power corresponding to the maximum electric current of the connection plus the electric current that the battery can supply. In this way the compressor can temporarily supply a higher capacity. Moreover, it is also possible to have the compressor operate independently when it is not connected, with electric current supplied by the battery alone.

The available power of the electrical grid can for example also be supplemented by power originating from one or more generators.

The available power of the electrical grid can also be supplemented for example with power originating from one or more connections to the same electrical grid and/or to one or more other electrical grids.

The invention also concerns an electrically driven mobile compressor or pump that is provided with two or more connections for connection to two or more different electricity supply sources that can supply the compressor or pump with current in parallel simultaneously, whereby one of the controllers is provided with an algorithm with which the electric current drawn from each supply source can be limited to a set or adjustable maximum value by distributing the total drawn electric current over the connected electricity supply sources and limiting the total drawn electric current to the sum of the set maximum current values of all connections to which electricity supply sources are connected by controlling the speed or pressure depending on whether a desired pressure or desired flow rate has been set.

To this end the electrically driven mobile compressor or pump is preferably equipped with means to measure or determine the current drawn per connection to an electricity supply source, continuously or at intervals.

Furthermore the electrically driven mobile compressor or pump is preferably equipped with additional means to be able to set the maximum current per connection.

Furthermore the electrically driven mobile compressor or pump is preferably equipped with additional means to enable the user to set how the algorithm must distribute the total drawn electric current over the connections to which an electricity supply source is connected.

According to a first distribution setting for example, a priority can be set for the connections, and the algorithm then draws current from the connections according to this priority to which an electricity supply source is connected.

According to a second distribution setting, it can be set for example that the algorithm of each connection to which an electricity supply source is connected, draws current in proportion to the maximum current set for this connection.

In a preferred embodiment of the invention, a volumetric compressor element is used in the electrically driven mobile compressor. A volumetric compressor element can be driven over a wide speed range by the electric motor so that accordingly maximum current values can be set over a wide range for the electrically driven mobile compressor.

In a preferred embodiment of the invention a volumetric rotary compressor element is used in the electrically driven mobile compressor, such as for example a screw compressor element, a roots blower element, a tooth compressor element, a rotary vane compressor element or a scroll element. A rotary compressor element can be driven over an even wider speed range by the electric motor, because it can be driven to higher speeds.

The invention is not limited to compressors for compressed air, but can also be applied to electrically driven mobile compressors for other gases and gas mixtures, such as for example nitrogen, carbon dioxide, steam and others.

A compressor generates a higher pressure at the outlet than at the inlet. It is well known that a compressor, if need be provided with extra adaptations to this end, can also be used to generate an underpressure, also called a vacuum, at the inlet. The invention can thus also be applied to a volumetric vacuum pump.

The invention also relates to a method for controlling the maximum electric current that can be drawn by a mobile compressor or pump from an electricity supply source, whereby the compressor or pump comprises a compressor element or pump element for supplying a pressurised fluid to a network of consumers and whereby the compressor element or pump element is coupled to an electric drive motor with a variable speed, characterised in that the method comprises the following steps:

- the connection of the compressor or pump to an electricity supply source;
- the determination of the maximum electric current that is desired or which is available from the supply source;
- the control of the speed of the drive motor or the pressure of the pressurised fluid, as a function of a set desired pressure or a set desired flow rate;
- the limitation of the controlled speed at a desired pressure, or the limitation of the controlled pressure at a desired flow rate, to a maximum value in order to limit the drawn current to the aforementioned maximum current;
- for the compressor or pump concerned, the prior calculation or determination of a fixed set value for the maximum value of the speed as a function of the characteristics of the machine and based on the set maximum current to be drawn together with the set desired pressure, or of a fixed set value for the pressure as a function of the set maximum current to be drawn together with the set desired flow rate respectively, to which the speed, or the pressure respectively, must be limited in order to limit the drawn current to the maximum current, or;
- the limitation of the speed, or the limitation of the pressure, to the aforementioned calculated or determined maximum value.

This method according to the invention presents the same advantages as those described above for the mobile compressor or pump according to the invention.

According to a second alternative the method comprises the following steps:

- the continuous or periodic measurement or determination of the electric current drawn from the supply source;
- the comparison of the measured drawn current to the maximum current;
- leaving the aforementioned control of the speed at a desired pressure, or the pressure at a desired flow rate, undisturbed when the measured current is less than the set maximum current;
- the limitation of the electric current drawn from the supply source to the maximum current by limiting the maximum value of speed in the case of a desired pressure, or by limiting the maximum value of the pressure in the case of a desired flow rate.
- When the supply source is provided with a fuse with a set safety current, a desired or chosen maximum current is adopted that at most is equal to the value of the safety current of the fuse, so that a maximum current can be used without the fuse cutting off the current.

The compressor or pump can optionally be provided with one or more electrical connections that are intended for any electricity supply of external electrical consumers, whereby the current of these electrical connections together with the current of the drive motor is drawn from the supply source. In such a case, the method preferably comprises a step for measuring the combined current drawn from the supply source and a step for limiting the combined electric current drawn from the supply source to the maximum current by controlling the speed and/or pressure.

This provides the advantage that the combined current drawn by the drive motor and the connected electrical consumers will never go above the protection value of the fuse of the supply source and the fuse will thus never disconnect the supply source.

Optionally the compressor or pump can be connected to two or more different electricity supply sources that can supply the compressor or pump with current in parallel simultaneously.

In such a case, the method according to the invention preferably comprises the following steps:

- for each supply source, the determination of the maximum electric current that is desired or which is available from the supply source;
- for each electricity supply source, the determination of the current drawn from the supply source concerned, continuously or at intervals;
- for each supply source, the limitation of the drawn current to the maximum current for the supply source concerned by distributing the total drawn electric current over the supply sources and limiting the total drawn electric current to the sum of the set maximum permissible current values of all connected supply sources by controlling the speed or the pressure.

The total drawn electric current can then be distributed over the connected supply sources proportionally or according to a chosen priority per connection.

BRIEF DESCRIPTION OF THE DRAWINGS

With the intention of better showing the characteristics of the invention a few embodiments and applications of a mobile electrically driven compressor according to the invention are described hereinafter, by way of an example without any limiting nature, with reference to the accompanying drawings, wherein.

DETAILED DESCRIPTION OF THE INVENTION

Figure 1:
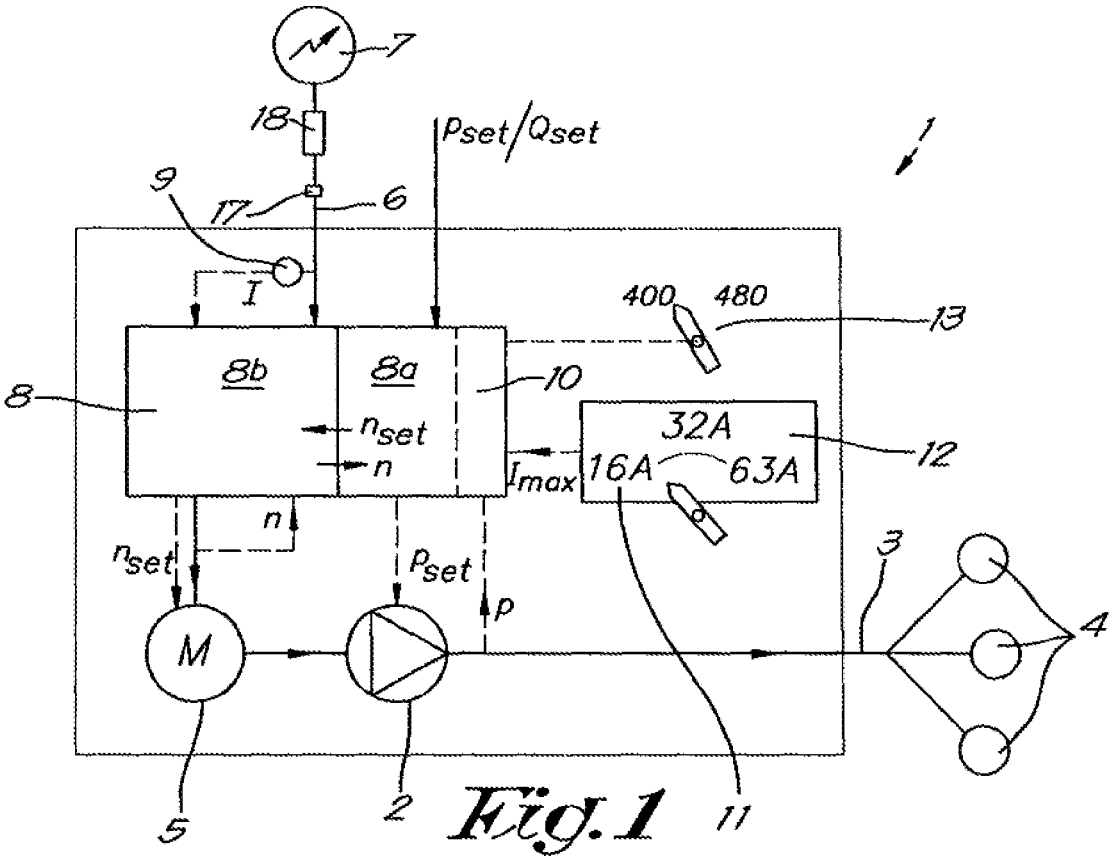
FIG. 1 schematically shows a compressor according to the invention.

FIG. 1 shows a mobile compressor 1 according to the invention comprising at least one compressor element 2 for compressing and supplying gas to a network 3 of consumers 4 of compressed gas; an electric drive motor 5 coupled to the compressor element 2 with a variable speed n, whereby this electric drive motor 5 is provided with a connection 6 to be able to be connected to an electricity supply 7 via a controller 8.

This controller 8 comprises:

- a first controller 8*a* of the compressor element 2 configured to control the speed n or the pressure p respectively of the compressor or pump as a function of a set desired pressure pset, or a set desired flow rate Qset, and,
- a second controller 8*b* configured for the variable speed control of the electric drive motor 5 as a function of a desired speed nset that is determined by the first controller 8*a*.

A normal control of a compressor can for example consist of, as is known, maintaining a set pressure pset in the network 3, or maintaining a determined set flow rate Qset.

In the case of a set pressure pset having to be maintained, if the demand from the network 3 for the supply of compressed gas becomes greater for example, the pressure p in the network 3 will fall and the controller 8*a* will respond to this by increasing the desired speed nset of the drive motor 5 in order for the compressor element 2 to supply a higher flow of compressed gas until the pressure is again equal to the set value pset.

In the case of a set flow rate Qset having to be maintained, if the pressure on the network 3 increases, the controller 8*b* will keep the speed n constant for example and the controller 8*b* will decrease the pressure with the speed remaining the same.

The compressor 1 of the example comprises means 9 to measure the electric current I drawn from the supply source 7 and to pass it on to the controller 8 as a suitable signal.

In the example of FIG. 1 the compressor 1 is further provided with a control system, which in this case is integrated in the controller 8, whereby this control system is provided with an algorithm 10 with which electric current I drawn from the supply source can be limited to a maximum value Imax by limiting the desired set speed nset or the desired set pressure pset to a maximum value, in the case of a set desired pressure pset or desired flow rate Qset respectively.

The maximum value Imax is adjustable by means of a first control 11 that is connected to the controller 8.

The control 11 is constructed in the form of a first multiposition switch for example, that enables a maximum value Imax of the current I to be set to a preprogrammed selection value, for example to be selected from a series of preset selection values on a selection scale 12. In the example, in this way a setting of 16, 32 or 63 amperes can be chosen depending on what is desired or what is available from the supply source 7.

In the case of FIG. 1, the selection scale 12 is itself also adjustable by means of a second control 13, for example in the form of a second multiposition switch, which for example enables the selection scale 12 to be adjusted to the current protections that are common in a certain region.

For example, in Europe a grid voltage of 400 volts is common with standard current protections of 16, 32, 63 and 125 amperes, while in the United States a grid voltage of 480 volts is usual with protections of 20, 30 and 50 amperes.

In the example of FIG. 1 the multiposition switch 13 can be set for example for use in Europe with a voltage of 400 volts and 16 amperes.

It is clear that the multiposition switch 13 can also be omitted, whereby for example the selection scale 12 comprises all common current values of current protection in a number of regions, for example a selection scale 12 with selection values 16, 20, 30, 32, 50 and 63 amperes for use in Europe and the United States.

It is also clear that there can be other possibilities for setting the maximum current strength, for example via a digital setting with a keyboard or similar.

The aforementioned algorithm 10 can for example consist of measuring the drawn current I, continuously or at intervals, and comparing it to the set maximum current Imax and conducting the control such that if the measured drawn current is less than the set maximum current Imax, the normal control of the speed n or the pressure by the aforementioned controller 8*a* and/or controller 8*b* is left undisturbed, but whereby, when the measured drawn current I is equal to or greater than the set maximum current Imax, the controller 8 will keep the speed n or the pressure p constant or decrease it until the measured drawn current I is again less than the set maximum current Imax.

When in a certain situation with a set desired pressure pset, for example, an extra consumer 4 is connected to the network 3, this will increase the demand for compressed gas. This will elicit a response from the controller 8 in a known way by increasing the speed n of the drive motor 5 of the compressor element 2. With the operating pressure in the network 3 remaining the same, this will lead to an increased current I drawn from the supply source 7.

For as long as the measured drawn current I in this situation is less than Imax, the variable speed control will be left undisturbed and it can adjust the speed n undisturbed within certain boundaries upon an increase or decrease of the consumption of the network 3, but when the measured current I is equal to Imax, the algorithm 10 will ensure that the speed cannot increase further or will decrease when the current I is greater than or threatens to become greater than Imax.

When in a certain situation with a set desired flow rate Qset, for example, the resistance of the network 3 changes, this will change the pressure, while the desired flow rate must remain constant. This will elicit a response from the controller 8 in a known way by adjusting the pressure p at a constant speed of the drive motor 5 of the compressor element 2. In the case of a pressure increase this will lead to an increased current I drawn from the supply source 7.

If a desired flow rate Qset has been set, in a certain situation in which the pressure in the network 3 decreases while the desired flow rate must remain constant, this will elicit a response from the controller 8 in a known way, by increasing the pressure p with the speed remaining the same, as controlled by the controller 8*b*. With a constant flow rate to the network 3 this will lead to an increased current I drawn from the supply source 7.

In this last case, as long as the measured drawn current I is less than Imax, the variable pressure control will be left undisturbed and it can adjust the pressure p to the pressure of the network 3 undisturbed within certain boundaries, but when the measured current I is equal to Imax the algorithm 10 will ensure that the pressure cannot increase further or will decrease when the current I is greater than or threatens to become greater than Imax.

Figure 2:
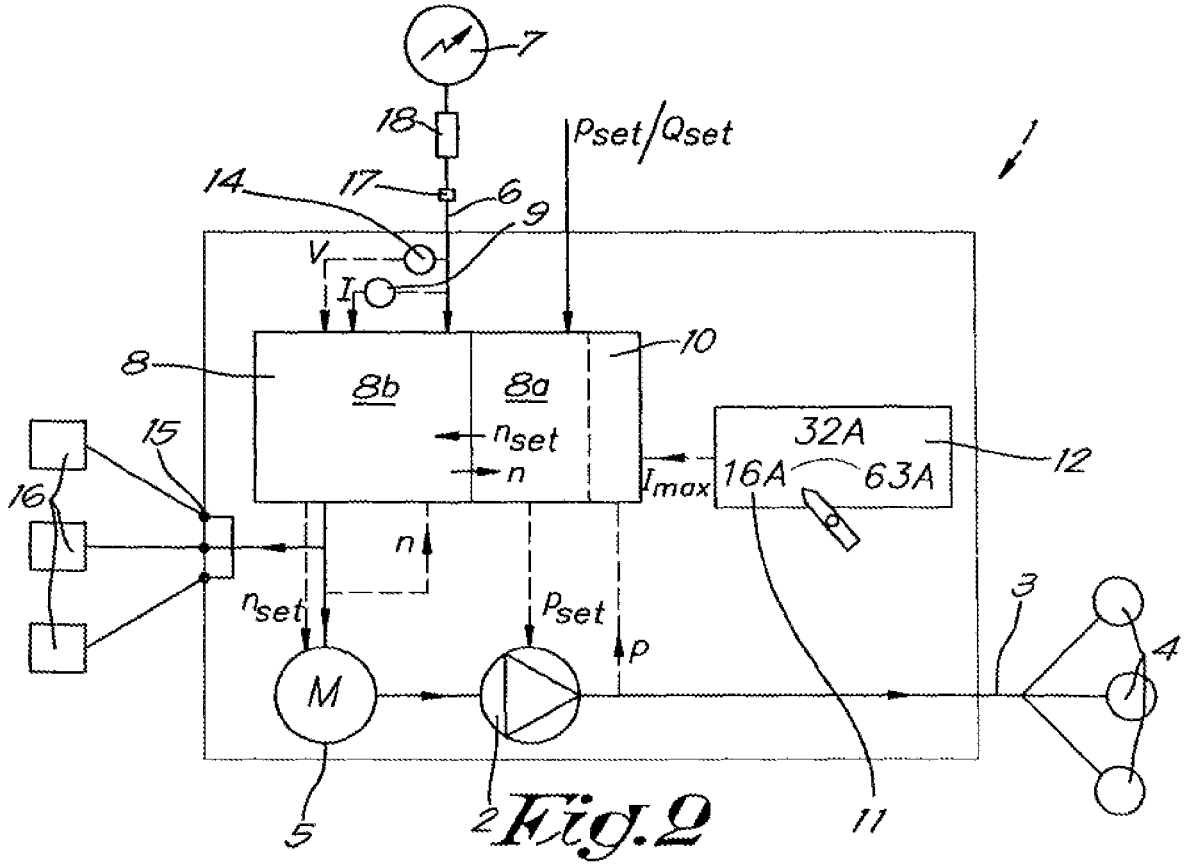
FIGS. 2 and 3 each show a possible variant embodiment of a compressor according to the invention.

FIG. 2 shows a variant of a compressor 1 according to the invention, whereby the selection scale 12 for the maximum current to be set by the controller 8 itself is determined as a function of the voltage V of the electricity supply source 7 to which the compressor 1 is connected, and which can be measured in a known way using a voltmeter 14. Alternatively instead of the voltage, the frequency or a combination of both can also be measured.

Furthermore this compressor 1 of FIG. 2 differs from the previous embodiment of FIG. 1 in the fact that it is provided with one or more electrical connections 15 that are tapped off downstream from the means 9, in this case downstream from the controller 8, and which are intended for the electricity supply of external electrical consumers 16. In this way the means 9 measure the current that is consumed by the drive motor 5 of the compressor element 2, the controller 8 and the external consumers 16 together.

It is thus ensured that the combined drawn current can never go above the limit of the set maximum current Imax.

In the example of FIGS. 1 and 2 the electricity supply 7 is taken from a power point 17 of an electrical grid, whereby this power point 17 is electrically protected by means of a fuse 18 or other protection of the electrical grid, the safety current of which determines the value of the maximum current Imax to be set for the electrically driven mobile compressor 1.

Figure 3:
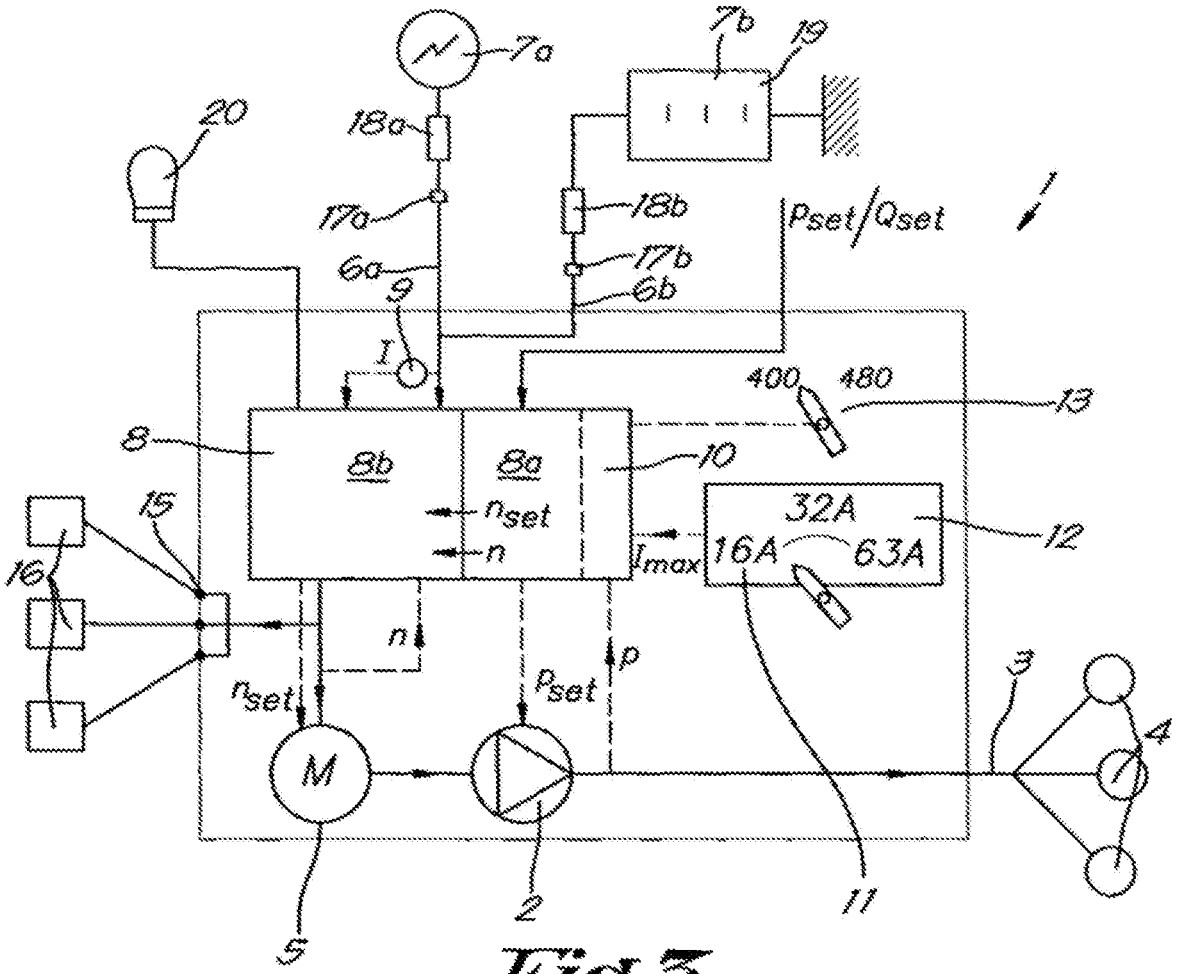

In FIG. 3 two different supply sources 7 are used for the electricity supply of the compressor 1, respectively a first supply source 7*a* in the form of a first connection 6*a* to an electrical grid and a second supply source 7*b* in the form of a second connection 6*b* to a battery pack 19. The first connection 6*a* comprises a power point 17*a* and is protected with a fuse 18*a*, the second connection 6*b* comprises a power point 17*b* and is protected with a fuse 18*b*.

Depending on the desired power and the situation, only the first supply source 7*a* or the second supply source 7*b* can be drawn on, and current can be drawn from both simultaneously in parallel, in which case an increased power is temporarily available if desired.

In the embodiment of FIG. 3 there is also an audio or visual signal 20 that gives an alarm when the maximum current Imax is reached or almost reached, or which indicates how much of the available current or power is consumed or is still available.

The present invention is by no means limited to the embodiments described as an example and shown in the drawings, but a mobile electrically driven compressor and method according to the invention can be realised in all kinds of forms and dimensions without departing from the scope of the invention.

The invention claimed is:

1. An electrically driven mobile compressor or pump comprising at least one compressor element or pump element for supplying a pressurised fluid to a network of consumers of such pressurised fluid; an electric drive motor with a variable speed control coupled to the compressor element or pump element, and an electric or electronic controller comprising a first controller configured to control the speed or the pressure of the compressor or pump, respectively as a function of a set desired pressure or a set desired flow rate, of the pressurised fluid demanded by the network, and a second controller configured for the variable speed control of the electric drive motor as a function of a desired speed that is determined by the first controller, and a connection for connecting the compressor or pump to an electricity supply source, wherein the controller is provided with an algorithm with which the electric current drawn from the supply source can be limited to a set or adjustable maximum value by limiting the controlled speed at a desired pressure, or limiting the controlled pressure at a desired flow rate, to a maximum value, the case of a set desired pressure or desired flow rate respectively, and whereby the electric or electronic control that limits the speed or the pressure in order not to exceed a maximum drawn current, is a control with a fixed set value of the maximum speed or of the maximum pressure, whereby this value is calculated or determined as a function of the characteristics of the compressor or pump and based on the set maximum current to be drawn together with the set desired pressure, or based on the set maximum current to be drawn together with the set desired flow rate respectively, wherein when a desired pressure has been set, the pressure is maintained and the speed is controlled to maintain the pressure for as long as the current drawn is below the set maximum current, and wherein, as soon as the drawn current reaches the set maximum current, the maximum speed is limited; and wherein when a desired flow rate has been set, the speed corresponding to the set flow rate is maintained and the pressure is adjusted to maintain the flow rate or speed for as long as the current drawn is below the set maximum current, and wherein, as soon as the drawn current reaches the set maximum current, the maximum pressure is limited.

2. The electrically driven mobile compressor or pump according to claim 1, wherein means are provided to be able to determine or measure the drawn current, continuously or at intervals, whereby the algorithm is such that, if the measured drawn current is less than the set maximum current, the control of the speed by the aforementioned controller is left undisturbed, but whereby, when the measured drawn current is equal to or greater than the set maximum current, the controller will keep the speed constant or decrease it until the measured drawn current is again less than the set maximum current.

3. The electrically driven mobile compressor or pump according to claim 1, wherein the compressor or pump is provided with a first control that enables a maximum permissible value of the current to be set.

4. The electrically driven mobile compressor or pump according to claim 3, wherein the first control can be set to a series of preprogrammed selection values.

5. The electrically driven mobile compressor or pump according to claim 4, wherein the preprogrammed selection values are shown on a selection scale, which itself is adjustable by means of a second control as a function of the current protection of electricity supply sources that are common in a certain region or similar.

6. The electrically driven mobile compressor or pump according to claim 4, wherein the electrically driven mobile compressor or pump is provided with means to determine the voltage and/or frequency of the electricity supply source and to show preprogrammed selection values of current protection on a selection scale that are common in a certain region or similar, in combination with the measured voltage and/or frequency.

7. The electrically driven mobile compressor or pump according to claim 4, wherein the electrically driven mobile compressor or pump is provided with means to determine the GPS coordinates of the compressor or pump and to show preprogrammed selection values of current protection on a selection scale that are common in the region where the compressor or pump is located according to the determined GPS coordinates.

8. The electrically driven mobile compressor or pump according to claim 3, wherein the aforementioned first control and/or a second control is or are protected by a key, a password or similar.

9. The electrically driven mobile compressor or pump according to claim 2, wherein it is provided with one or more electrical connections that are intended for any electricity supply of external electrical consumers, whereby the current of one or more electrical connections is tapped off at a location downstream from the means for determining or measuring the drawn current, so that the current that is measured with the means is the combined current drawn from the supply source by the compressor or pump and by the electrical consumers connected to the electrical connections concerned.

10. The electrically driven mobile compressor or pump according to claim 2, wherein the aforementioned electricity supply source is taken from a power point of an electrical grid, whereby this power point is electrically protected by a fuse of the electricity supply source or of an electrical grid, whereby the safety current of the fuse determines the value of the maximum current to be set on the electrically driven mobile compressor or pump.

11. The electrically driven mobile compressor or pump according to claim 1, wherein it is provided with an audio or visual signal that gives an alarm when the maximum current is reached or is almost reached, or which indicates how much of the available current or power is consumed or is still available.

12. The electrically driven mobile compressor or pump according to claim 1, wherein it comprises two or more connections for connection to two or more different electricity supply sources that can supply the compressor or pump with current in parallel simultaneously.

13. The electrically driven mobile compressor or pump according to claim 12, wherein for each connection for connection to an electricity supply source, it is provided with means to determine the drawn current, continuously or at intervals, and to set a maximum permissible value of the current per connection.

14. The electrically driven mobile compressor or pump according to claim 13, wherein the controller is provided with an algorithm with which the drawn electric current per connection can be limited to the set maximum permissible value for this connection, by distributing the total drawn electric current over the connected electrical connections and limiting the total drawn electric current to the sum of the set maximum permissible current values of all connections to which electricity supply sources are connected by controlling the speed.

15. The electrically driven mobile compressor or pump according to claim 14, wherein the compressor or pump is provided with a control that can be set so that the total electric current is drawn proportionally or according to an adjustable priority per connection.

16. The electrically driven mobile compressor or pump according to claim 12, wherein at least a first connection is provided for connection to an electrical grid and at least a second connection is provided for connection to a battery pack with one or more batteries to increase the available electric power with respect to the available power of the first connection.

17. The electrically driven mobile compressor or pump according to claim 16, wherein the electrically driven mobile compressor or pump is provided with means for charging the battery pack.

18. The electrically driven mobile compressor or pump according to claim 1, wherein the compressor element or pump element is a volumetric compressor element or pump element.

19. The electrically driven mobile compressor or pump according to claim 18, wherein the compressor element or pump element is a rotary compressor element or pump element.

20. A method for controlling a maximum electric current that can be drawn by a mobile compressor or pump from an electricity supply source, whereby the compressor or pump comprises a compressor element or pump element for supplying a pressurised fluid to a network of consumers and whereby the compressor element or pump element is coupled to an electric drive motor with a variable speed control, wherein the method comprises the following steps:

connecting the compressor or pump to an electricity supply source;

determining the maximum electric current that is desired or which is available from the supply source and setting the maximum electric current thus determined as the maximum electric current that can be drawn by the mobile compressor or pump;

controlling the speed of the drive motor, or the pressure of the pressurised fluid, respectively as a function of a set desired pressure, or a set desired flow rate; and limiting the controlled speed at a desired pressure, or limiting the controlled pressure at a desired flow rate, to a maximum value in order to limit the drawn current to the aforementioned maximum current;

wherein for the compressor or pump concerned, the prior calculation or determination of a fixed set value for the maximum value of the speed as a function of the characteristics of the compressor or pump and based on the set maximum current to be drawn together with the set desired pressure, or of a fixed set value for the pressure as a function of the set maximum current to be drawn together with the set desired flow rate respectively, to which the speed, or the pressure respectively, must be limited in order to limit the drawn current to the maximum current, or;

the limitation of the speed, or the pressure, to the aforementioned calculated or determined maximum value, and wherein when a desired pressure has been set, the pressure is maintained and the speed is controlled to maintain the pressure for as long as the current drawn is below the set maximum current, and wherein, as soon as the drawn current reaches the set maximum current, the maximum speed is limited; and wherein when a desired flow rate has been set, the speed corresponding to the set flow rate is maintained and the pressure is adjusted to maintain the flow rate or speed for as long as the current drawn is below the set maximum current, and wherein, as soon as the drawn current reaches the set maximum current, the maximum pressure is limited.

21. The method according to claim 20, wherein the method further comprises the following steps:

the continuous or periodic measuring or determining of the electric current drawn from the supply source;

comparing the measured drawn current to the maximum current;

leaving the aforementioned control of the speed at a desired pressure, or the pressure at a desired flow rate, undisturbed when the measured current is less than the set maximum current; and limiting the electric current drawn from the supply source to the maximum current by limiting the maximum value of speed in the case of a desired pressure, or by limiting the maximum value of the pressure in the case of a desired flow rate.

22. The method according to claim 20, wherein the supply source is provided with a fuse with a set safety current and the desired or selected maximum current is at most equal to the safety current of the fuse.

23. The method according to claim 20, wherein the compressor or pump is provided with one or more electrical connections that are intended for any electricity supply of external electrical consumers, whereby the current of these electrical connections together with the current of the drive motor is drawn from the supply source and whereby the method comprises the step of measuring the combined current drawn from the supply source and the step of limiting the combined electric current drawn from the supply source to the maximum current by controlling the speed.

24. The method according to claim 20, wherein it further comprises the step of generating an audio or visual signal that gives an alarm when the maximum current is reached or almost reached, or which indicates how much of the available current or power is consumed or is still available.

25. The method according to claim 20, wherein it further comprises connecting the compressor or pump to two or more different electricity supply sources that can supply the compressor or pump with current in parallel simultaneously and further comprises the following steps:

for each supply source, determining of the maximum electric current that is desired or which is available from the supply source;

for each electricity supply source, determining of the current drawn from the supply source concerned, continuously or at intervals; and for each supply source, limiting of the drawn current to the maximum current for the supply source concerned by distributing the total drawn electric current over the supply sources and limiting the total drawn electric current to the sum of the set maximum permissible current values of all connected supply sources by controlling the speed at a desired pressure or the pressure at a desired flow rate.

26. The method according to claim 25, wherein the total drawn electric current is distributed over the connected supply sources proportionally, or according to a chosen priority per connection.

27. The method according to claim 20, wherein it makes use of a compressor or pump comprising at least one compressor element or pump element for supplying a pressurised fluid to a network of consumers of such pressurised fluid; an electric drive motor with a variable speed control coupled to the compressor element or pump element, and an electric or electronic controller comprising a first controller configured to control the speed or the pressure of the compressor or pump, respectively as a function of a set desired pressure or a set desired flow rate, of the pressurised fluid demanded by the network, and a second controller configured for the variable speed control of the electric drive motor as a function of a desired speed that is determined by the first controller, and a connection for connecting the compressor or pump to an electricity supply source, wherein the controller is provided with an algorithm with which the electric current drawn from the supply source can be limited to a set or adjustable maximum value by limiting the desired set speed, or the desired set pressure, to a maximum value and whereby the electric or electronic control that limits the speed or the pressure in order not to exceed a maximum drawn current, is a control with a fixed set value of the maximum speed or of the maximum pressure, whereby this value is calculated or determined as a function of the characteristics of the machine and based on the set maximum current to be drawn together with the set desired pressure, or based on the set maximum current to be drawn together with the set desired flow rate respectively.

* * * * *